US006412842B1

(12) United States Patent
Winston

(10) Patent No.: US 6,412,842 B1
(45) Date of Patent: Jul. 2, 2002

(54) SCOOP FOR SLOT MACHINE TRAY

(76) Inventor: Nadine Winston, 2801 Crabtree La., Northbrook, IL (US) 60062

( * ) Notice: Subject to any disclaimer, the term of this patent is extended or adjusted under 35 U.S.C. 154(b) by 0 days.

(21) Appl. No.: 09/692,134

(22) Filed: Oct. 19, 2000

(51) Int. Cl.[7] ..... A47F 13/08
(52) U.S. Cl. ..... 294/55
(58) Field of Search ..... 294/1.3, 55; 15/257.1–257.3; 453/58, 61, 63; D8/10; D30/162; D99/34

(56) References Cited

U.S. PATENT DOCUMENTS

| | | | | | |
|---|---|---|---|---|---|
| 132,134 | A | * | 10/1872 | Bowers | 294/55 |
| 264,072 | A | * | 9/1882 | French | 294/55 |
| 961,199 | A | * | 6/1910 | Armstrong | 15/257.3 |
| 2,026,078 | A | * | 12/1935 | Walker | 294/55 X |
| 2,182,464 | A | | 12/1939 | Blackstone | |
| 2,563,223 | A | * | 8/1951 | Dreher | 294/55 |
| 3,107,467 | A | | 10/1963 | Gates | |
| 3,163,170 | A | | 12/1964 | Gates | |
| 3,408,681 | A | * | 11/1968 | Isakson | 15/257.2 |
| 3,840,261 | A | * | 10/1974 | Fulkerson et al. | 294/55 |
| 4,091,599 | A | | 5/1978 | Lemieux | |
| 4,154,252 | A | | 5/1979 | Elias | |
| D267,357 | S | * | 12/1982 | Hillstrom | 294/55 X |
| 4,425,927 | A | | 1/1984 | Smith | |
| 4,432,379 | A | | 2/1984 | Cantley | |
| 4,646,795 | A | * | 3/1987 | Hebron et al. | 294/55 X |
| D301,930 | S | * | 6/1989 | Cantu | D99/34 |
| D308,277 | S | | 5/1990 | Walker | |
| 5,021,027 | A | | 6/1991 | Bremer | |
| D343,940 | S | | 2/1994 | Glass | |
| 5,318,330 | A | * | 6/1994 | Dombrowski | 294/55 X |

FOREIGN PATENT DOCUMENTS

| | | | | |
|---|---|---|---|---|
| AT | 188470 | * | 1/1957 | 294/55 |
| FR | 991510 | * | 10/1951 | 294/55 |

* cited by examiner

*Primary Examiner*—Johnny D. Cherry
(74) *Attorney, Agent, or Firm*—Welsh & Katz, Ltd.

(57) ABSTRACT

A scoop configured for retrieving objects from a slot machine tray and for containing the objects when oriented in a horizontal position or a vertical position, includes a frame and a handle. The frame has a bottom wall, a back wall, two opposing side walls and a cover that define an aperture for collecting, retaining and accessing the retained objects. The opposing side walls each have a back portion and a front portion. The side walls are contiguous with the bottom wall forming a lower edge at intersection. The side wall back portions each have an upper edge substantially parallel to the lower edge. The upper edge is contiguous with the cover. The cover and back portion are the same length. The front portions of the side walls each have a sloped, unassociated upper edge. The handle is connected to the back wall of the scoop frame and extends substantially perpendicular to the frame from an upper portion of the back wall. The handle extends generally coplanar with the cover and is spaced from a plane defined by the bottom wall. The scoop is constructed from a durable plastic for resiliency, lightweight and durability.

11 Claims, 1 Drawing Sheet

SCOOP FOR SLOT MACHINE TRAY

FIELD OF THE INVENTION

The present invention pertains to a slot machine scoop. More particularly, this invention relates to a new and improved coin scoop to enable efficient and accurate coin retrieval from a slot machine tray.

BACKGROUND OF THE INVENTION

Slot machines are a universally popular form of gambling entertainment. In just one pull of a lever, a player can win a jackpot anywhere from one dollar to over tens of thousands of dollars. When this happens, the slot machine dispenses coins into a tray, generally located on the lower portion of the machine.

Typically, the player collects the slot machine coins with his or her bare hands. For some players, gathering the coins from the slot machine tray can be a rather arduous task. The typical slot machine tray is narrow in width, spans the width of the slot machine, and is tightly located below the overhang of the machine, providing a very limited space for coin retrieval. For a player suffering from an arthritic hand condition, hand injury, or a disability, retrieval of the small coins from the slot machine tray can be a virtually impossible chore. In addition, for any person that plays "the slots" for hours upon hours, or is fortunate enough to hit a big jackpot amounting to hundreds of coins, coin retrieval with one's hands can be rather undesirable.

In addition, collecting coins from the coin tray can be both a hygienic as well as a personal injury risk. These trays can collect dirt and other debris, which can result in spreading and/or infiltrating dirt, and cuts or abrasions to a user's hand or fingers.

Scoops and scooping devices are relatively well-known in the art. A conventional scoop, has a shovel-like frame, as shown in U.S. Des. Pat. No. 343,940 to Glass. The inherent disadvantage of this scoop, and other similar designs, is that the shovel-like frame has an open-top. This configuration does not protect against the possibility of spilling the objects. When a user attempts to scoop numerous items with an open-top frame scoop, some of the scooped objects will inevitably spill over the top of the back wall. This is undesirable for player's wishing to efficiently retrieve their coins from the slot machine tray.

Another disadvantage of the open-top frame scoop, is that in order to effectively contain the coins inside the frame of the scoop, it must be maintained in a substantially horizontal position. If the scoop is not maintained in a substantially horizontal position, again the coins will inevitably spill from the frame. This limitation is rather impractical for a mobile player hoping to keep his or her winnings inside the scoop.

Other similar scoops, like the one shown in U.S. Des. Pat. No. 301,930, have a shovel-like frame comprised of two panels. In this design, the front panel is angled upward, and the handle is angled downward. This scoop configuration is impractical for use in the tightly spaced environment of a slot machine tray.

Accordingly, there exists a need for a scoop that permits accurate and efficient coin retrieval from a slot machine tray. Ideally, such a scoop is capable of being used in the tight space below the slot machine overhang and is light and sturdy sufficiently to facilitate coin scooping and containment. In addition, the scoop frame should allow a player to scoop and carry his or her coins inside the scoop without risking spillage.

SUMMARY OF THE INVENTION

A scoop is configured for retrieving objects from a slot machine tray and for containing the objects when oriented in a horizontal position and vertical position. The scoop includes a frame and an associated handle. The frame has a bottom wall, a back wall, two opposing side walls and a cover, defining an aperture for collecting and retaining the objects.

The two opposing side walls each have a rear portion and a front portion. The back wall is contiguous with each side wall, forming dual lower edges. The rear portions of the opposing side walls each have an upper edge, which is substantially parallel to a respective lower edge. The upper edge is attached to the cover. The rear portion and the cover have the same length. The opposing side walls and back wall have the same height. Preferably, the opposing side walls and back wall have a height of about 1½ inches.

In addition to the lower edge previously defined, the front portions of the opposing side walls have sloped upper edges. The upper edges are openly unassociated. The bottom wall is substantially flat. The bottom wall has a front end forming a front edge, and a back end contiguous with the back wall forming a back edge. The front edge has chamfered ends.

The frame may have a variety of lengths; however, it is preferable that the frame length range between about 4 inches and about 7 inches.

The handle extends from the top portion of the back wall in a substantially perpendicular manner to the back wall. The handle may be one solid part. However, to further enable lightweight usage, the handle may have dual portions with a top portion and bottom portion, forming a hollow cavity between the top and bottom portions, essentially defining an "I" cross-section. In addition, the handle can include an arcuate end, forming a connection between the top portion and the bottom portion of the handle.

In another example of the scoop, the frame has a curved bottom wall to facilitate coin collection and containment.

To further enable usage, the scoop may be constructed from a durable lightweight plastic. In addition, the cover may be separately constructed and inserted onto the frame.

Other features and advantages of the present invention will be apparent from the following detailed description, the accompanying drawings in conjunction with the appended claims.

DETAILED DESCRIPTION OF THE PREFERRED EMBODIMENTS

Figure 1:
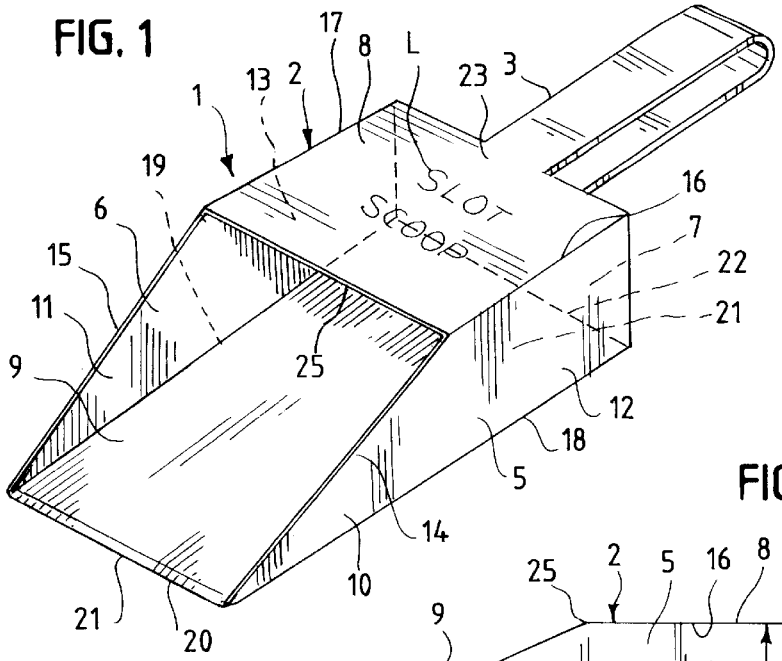
FIG. 1 is a perspective view of the slot machine scoop.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

Referring now to the figures and in particular, FIG. 1, there is shown a slot machine coin scoop 1. The slot machine scoop 1 has a frame 2 and handle 3 for scooping objects from a surface and for containing the objects. The collected objects may be coins, chips, or any other object capable of being collected into frame 2. Frame 2 has a bottom wall 4, opposing side walls 5 and 6, back wall 7, and a cover 8, defining an aperture 9 for access to a containment or storage region, as indicated at 21.

The bottom wall 4 intersects the opposing side walls 5 and 6, forming lower edges 18 and 19, respectively. The bottom wall has a front edge 20 for initial contact with the scooped items during scooping.

The bottom wall 4 intersects the back wall 7, forming a back edge 22. The two side walls each have a front portion 10 and 11, and respective rear portions 12 and 13. The front portions 10 and 11 have respective angled top edges 14 and 15. The cover 8 intersects the opposing side wall rear portions 12 and 13 forming respective edges 16 and 17. The upper edges 16 and 17 are substantially parallel to the lower edges 18 and 19. The front edge 20 is chamfered, as indicated at 21, to facilitate readily scooping objects into the scoop 1.

During scooping, the aperture 9 receives the scooped objects for containment. Aperture 9 permits access to the collected objects when the scoop 1 is held in a horizontal position.

The handle 3 is connected to the frame 2. The handle has a top portion 30 and bottom portion 31 defining a cavity 33. The top portion 30 and bottom portion 31 are contiguous with one another, forming an arcuate end 32.

Figure 2:
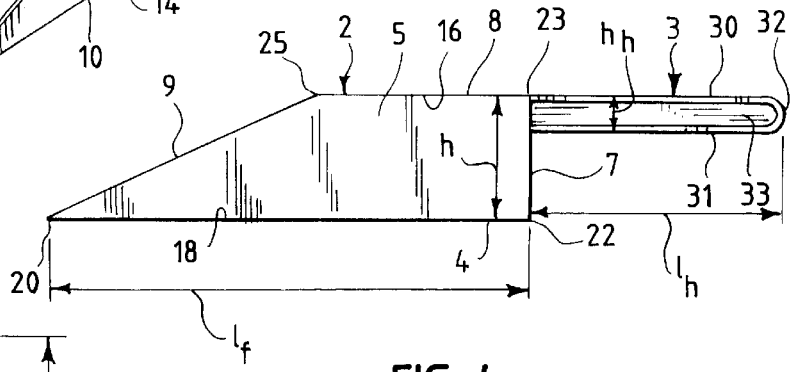
FIG. 2 is a side view of the slot machine scoop, further illustrating preferable dimensions thereof.
Figure 3:
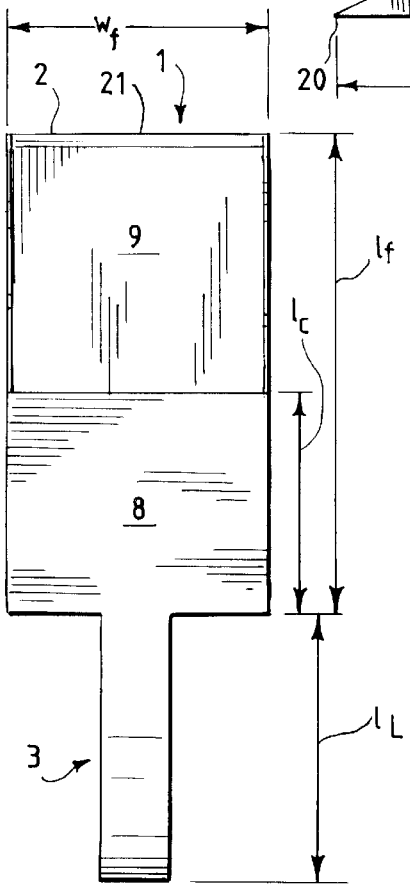
FIG. 3 is a top view of the slot machine scoop, showing the covered containment portion relative to the open frame.

Referring now to FIGS. 2 and 3, the frame 2 has a length $l_f$ of about 5½ inches, a height $h_f$ of about 1½ inches and a width $w_f$ of about 3½. The handle 3 has length $l_h$ of about 3 inches, and a height $h_h$ of approximately ½ inch. The handle 3 is mounted to the frame 2 at about an upper portion of the back wall 7, as indicated at 23, at about the juncture of the back wall 7 and the cover 8. It has been found that this arrangement permits "control" of the scoop 1, even with a substantial amount (i.e., number) of coins, and thus weight, within the frame 2. It has also been found that the placement or attachment of the handle 3 to the frame 2 at this elevated location along the back wall 7 facilitates scooping coins from the slot machine tray, while maintaining a user's hand and fingers spaced from the tray. It has also been observed that "control" of the scoop is enhanced by the substantially coplanar arrangement of the handle 3 with the cover or top wall 8. That is, it is considerably easier to prevent spillage of the contained coins with the handle 3 about coplanar with the cover 8.

Referring now to FIG. 3, the cover 8 has a length $l_c$ that is approximately half of the length $l_f$ of the entire frame 2. This permits readily scooping the objects (e.g., the coins) from the tray while providing a top (i.e., cover 8) that retains the coins within the frame 2, and permits readily viewing the coins within the frame 2. In this manner, the scoop 1 can be used to scoop coins from a tray while there are coins within the frame 2, and also permits using the scoop as a storage receptacle while playing the slots. That is, the scoop can be oriented vertically to hold the coins, and reoriented horizontally to scoop coins while playing. In addition because of the open front (i.e., the aperture 9), the user can look into the scoop 1 to see the quantity of coins therein at any given time.

Figure 4:
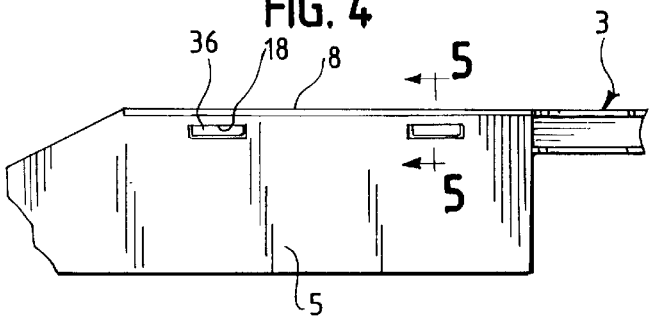
FIG. 4 is a partial side view of an alternate arrangement of the scoop having a removable cover.
Figure 5:
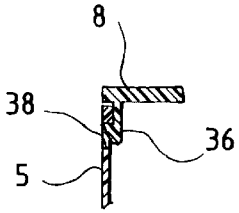
FIG. 5 is a cross-sectional view taken along line 5—5 of FIG. 4.

As seen in FIGS. 4 and 5, it is also contemplated that the cover 8 can be formed as a separate, removable part of the scoop 1 and can be attached to the frame 2 by hooks 36 and openings 38, which arrangement will be recognized by those skilled in the art. It is further contemplated that the cover 8 can include indicia such as a logo L (as seen in FIG. 1), design or the like, that can be specifically designed for, for example, a particular, desired casino gaming house or the like.

A present scoop 1 is formed from a resilient, light-weight, durable, yet cost-effective material. These materials include, for example, acrylonitrile butadiene styrene copolymer (commonly known as ABS), polyethylene terephthalate (commonly known as PET), an the like. These as well as other plastics that are usable for the present scoop 1 will be recognized by those skilled in the art, and are within the scope and spirit of the present invention.

It is also contemplated that the present scoop 1 can be formed from materials having a variety of aesthetic characteristics. For example, the scoop 1 can be formed from a translucent, colored material in which glitter or the like is embedded or combined to provide an interesting "look". In addition, the material can be colorfully endowed with stripes or the like to provide an appealing presentation. It is also contemplated that the scoop 1 can include other marketing and/or advertising materials to complement the particular scoop being made. In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A scoop configured for retrieving objects from an associated slot machine tray, the tray having a width, the scoop configured for containing and retaining the retrieved objects when oriented in a horizontal position and when oriented in a vertical position, the scoop comprising:

a frame having a bottom wall, a back wall, two opposing side walls and a cover, the bottom wall, opposing side walls and the cover defining an aperture for collecting, retaining and accessing the objects contained therein, the opposing side walls each having a rear portion and a front portion, the opposing side walls being contiguous with the bottom wall forming parallel lower edges, the rear portion of each opposing side wall being contiguous with the cover and forming opposing upper edges substantially parallel to their respective lower edges, wherein the cover and a back portion each have a length substantially equal to one another, the front portion of each opposing side wall having a sloped upper edge, the bottom wall having a front end forming a front edge, and a back end contiguous with the back wall, the front edge being chamfered; and a handle connected to the back wall and extending substantially perpendicular to the frame, the handle having an upper surface and a lower surface, the upper surface being substantially coplanar with a plane defined by the cover and spaced from a plane defined by the bottom wall.

2. The scoop in accordance with claim 1, wherein the handle has a top portion and a bottom portion defining a cavity therebetween and wherein the top portion and bottom portion are contiguous with one another forming an arcuate end.

3. The scoop in accordance with claim 2, wherein the frame has a width of about 3½ inches, a height of about 1½ inches and a length of about 5½ inches.

4. The scoop in accordance with claim 3, wherein the handle has a length of about 3 inches.

5. The scoop in accordance with claim 1 wherein the scoop is formed from a plastic material.

6. The scoop in accordance with claim 5 wherein the cover includes indicia therein.

7. The scoop in accordance with claim 5 wherein the material is opaque.

8. A scoop configured for retrieving objects from an associated slot machine tray, the tray having a width, the scoop configured for containing and retaining the retrieved objects when oriented in a horizontal position and when oriented in a vertical position, the scoop comprising:

a frame having a bottom wall, a back wall, two opposing side walls and a cover, the bottom wall, opposing side walls and the cover defining an aperture for collecting, retaining and accessing the objects contained therein, the frame having a length of about 5½ inches, a width of about 3½ inches and a height of about 1½ inches, the opposing side walls each having a rear portion and a front portion, the opposing side walls being contiguous with the bottom wall forming parallel lower edges, the rear portion of each opposing side wall being contiguous with the cover and forming opposing upper edges substantially parallel to their respective lower edges, wherein the cover and a back portion each have a length substantially equal to one another, the front portion of each opposing side wall having a sloped upper edge, the bottom wall having a front end forming a front edge, and a back end contiguous with the back wall, the front edge being chamfered; and a handle, connected to the back wall and extending substantially perpendicular to the frame, the handle having a top portion and a bottom portion forming a cavity therebetween, the top portion and bottom portion being connected to one another at an arcuate end, the handle extending from the back wall wherein the top portion is substantially coplanar with a plane defined by the cover and is spaced from a plane defined by the bottom wall, the handle having a length of about 3 inches.

9. The scoop in accordance with claim 8 wherein the scoop is formed from a plastic material.

10. The scoop in accordance with claim 9 wherein the cover includes indicia therein.

11. The scoop in accordance with claim 9 wherein the material is opaque.

* * * * *